US005983417A

United States Patent [19]

Perdreau et al.

[11] Patent Number: 5,983,417

[45] Date of Patent: Nov. 16, 1999

[54] HYDRO-THERAPY SPA JET NOZZLE

[75] Inventors: Andre Perdreau, Northridge; Loren Perry, Fountain Valley, both of Calif.

[73] Assignee: American Products, Inc., Moorpark, Calif.

[21] Appl. No.: 09/240,314

[22] Filed: Jan. 29, 1999

Related U.S. Application Data

[63] Continuation of application No. 08/727,106, Oct. 8, 1996.

[51] Int. Cl.[6] ..... A61H 33/02

[52] U.S. Cl. ..... 4/541.6; 4/541.4

[58] Field of Search ..... 4/541.1–541.6, 4/492; 239/518, 499, 590, 590.3, 590.5, 553, 553.3, 553.5

[56] References Cited

U.S. PATENT DOCUMENTS

| | | |
|---|---|---|
| 1,148,630 | 8/1915 | Schmidt . |
| 2,956,400 | 10/1960 | Ferri . |
| 2,990,123 | 6/1961 | Hyde . |
| 3,031,147 | 4/1962 | Goodrie . |
| 3,103,155 | 9/1963 | Boylan et al. . |
| 3,363,843 | 1/1968 | Ballard et al. . |
| 3,814,001 | 6/1974 | Hill . |
| 4,082,091 | 4/1978 | Raab . |
| 4,264,039 | 4/1981 | Moreland . |
| 4,408,721 | 10/1983 | Cohen et al. . |
| 4,508,665 | 4/1985 | Spinnett . |
| 4,797,958 | 1/1989 | Guzzini . |
| 5,000,665 | 3/1991 | Moeller . |
| 5,083,328 | 1/1992 | Toson . |
| 5,095,558 | 3/1992 | Howard . |
| 5,265,286 | 11/1993 | Filipponi . |
| 5,271,561 | 12/1993 | Tobias et al. . |
| 5,335,376 | 8/1994 | Kaldewei . |
| 5,462,230 | 10/1995 | Van Ouwerkerk . |

FOREIGN PATENT DOCUMENTS

| | | |
|---|---|---|
| 425-746A | 5/1991 | European Pat. Off. . |
| 3820-349A | 12/1989 | Germany . |

*Primary Examiner*—Charles R. Eloshway
*Attorney, Agent, or Firm*—Pretty, Schroeder & Poplawski, P.C.

[57] ABSTRACT

A hydro-therapy spa jet including an inlet connection, a first nozzle to accelerate a water stream from the inlet connection, an air inlet, a second nozzle drawing air from the air inlet to aerate the accelerated water stream, and a third nozzle to slow and directionally adjust the aerated water stream. The third nozzle includes an inlet, a chamber, and an orifice, where the aerated water stream passes into the inlet, through the chamber, and out the orifice. The inlet has a conical inner surface that contracts in a downstream direction. The inlet also includes a spherical outer surface, which is received in a conforming spherical inner surface within the jet. The chamber is conical in shape, expanding in the downstream direction to reduce the water's speed as it passes through the chamber. The orifice defines a passage having a cross-sectional area that is constant in the downstream direction. The third nozzle includes one or more long, tapered vanes fixed within the chamber, dividing the chamber into a plurality of segments. The vanes have a thick, rounded upstream end, and taper down to a pointed downstream end. The third nozzle also includes a rounded, teardrop-shaped protrusion extending upstream within the third nozzle. The protrusion is suspended within the third nozzle on the vanes, and has a cross-sectional area that decreases in the downstream direction.

8 Claims, 2 Drawing Sheets

FIG. 3
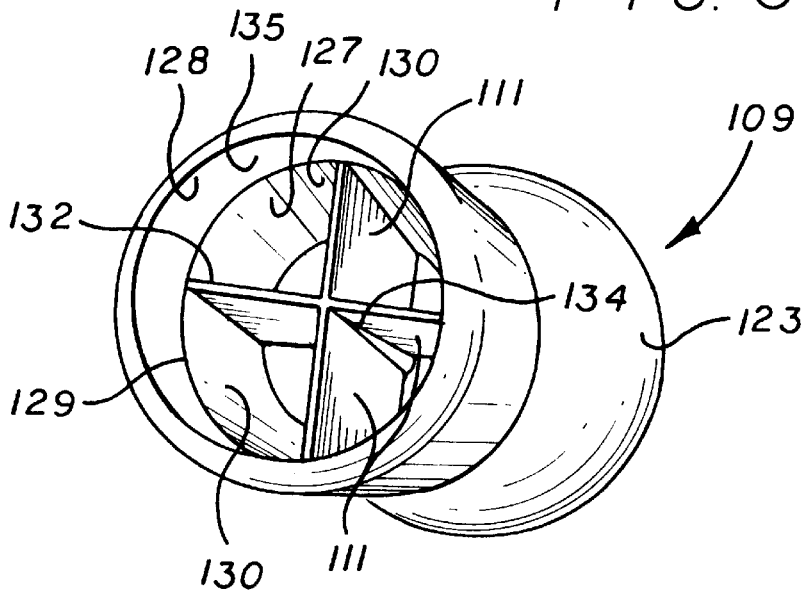
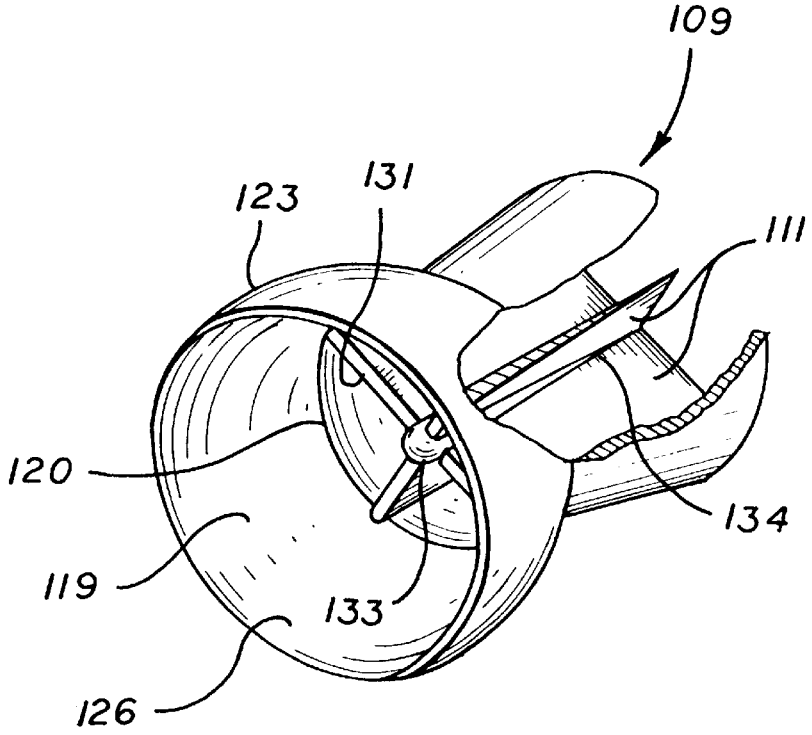
FIG. 4

HYDRO-THERAPY SPA JET NOZZLE

The present application is a continuation of U.S. patent application Ser. No. 08/727,106, filed Oct. 8, 1996, and the entire disclosure of such prior application is hereby incorporated herein by reference.

BACKGROUND OF THE INVENTION

This invention relates generally to tubs and spas, and, more particularly, to a jet for aerating a liquid flow, and the methods by which the jet works.

Hydro-therapy is a useful form of physical therapy. In hydro-therapy, patients rest in a body of water within a spa, while their anatomy is massaged by an aerated water stream flowing out of a hydro-therapy spa jet. The jet provides this stream of aerated water by directing an aerated water stream through a nozzle, into the body of water, and against the portion of the patient's anatomy where the massaging action is desired. A high water stream speed is necessary for aerating the water stream; however, high water stream speeds produce strong aerated water streams that quickly become uncomfortable on many parts of a patient's anatomy. Furthermore, when directional control is incorporated into hydro-therapy spa jets, back pressure generally results, interfering with the process of aeration. Accordingly, it has been an important aim of hydro-therapy spa jet designers to design hydro-therapy spa jets that produce a well-aerated stream of water that is not uncomfortably strong, and may be directionally controlled.

A common form of hydro-therapy spa jet includes a first nozzle that accelerates a stream of water, feeding it into a second nozzle. The accelerated water becomes aerated in the second nozzle, and then passes out through a third nozzle into a body of water with enough penetration to create a massaging action. Proper aeration produces a stream of water that is particularly penetrating. While this design is widely used in the hydro-therapy spa and tub business, it is unforgiving to changes in the first nozzle, air chamber, and third nozzle. Any changes in these areas can cause vast fluctuations in the operation of the jet and can even cause the jet not to draw air, which stops the massaging action.

This design limitation provides a narrow window of parameters in which to operate, and leads to aerated water streams that are strong, and can become relatively uncomfortable after a short time. Efforts to create other hydro-therapy spa jet designs to soften this feel have resulted in jets that perform in a very limited pressure and speed range with very little air being drawn into the water stream.

In an attempt to better regulate the mixture of air and water, some nozzle designs incorporate plugs or rods suspended in the water stream, where the plugs or rods are adjustable to control the size of openings leading either to the air or water supplies. Such plugs or rods naturally extend through the jet's second nozzle to lodge in the pathway of either the air or water sources. These plugs or rods are generally suspended in the water stream by a number of vanes connecting the plug or rod to the third nozzle. Such systems, while providing for adjustable control, do not overcome the above-mentioned problems relating to uncomfortably strong water streams or back pressure. Furthermore, these systems do not feature vanes or protrusions, positioned in an aerated water stream, that have a thickness or cross-sectional area decreasing in the downstream direction.

The use of nozzles with an increasing diameter is known for designs attempting to moderate water stream strength. Such nozzles, however, commonly suffer from significant internal turbulence, leading to additional back pressure. In particular, the portion of the water stream near the nozzle wall decreases in speed more than the water in the center of the nozzle. This speed differential causes turbulence, and thus significant back pressure.

These nozzles also experience a bleed off of the flow around the downstream end of the nozzle. The use of a constant diameter section at the downstream end of an increasing diameter nozzle is known to limit the bleed off problems, accelerating the water stream speed around the water stream's outer edges. The effectiveness of this mechanism, however, is limited by the turbulence already occurring within the nozzle.

It is generally known that a nozzle with a spherical exterior can be mounted in a socket with a conforming spherical interior to produce a directional nozzle that may be rotated in an eyeball-like fashion. Such nozzles, however, deflect only a portion of the water stream, thus disrupting laminar flow and creating a turbulent stream that does not correctly flow to the location at which it is aimed. Furthermore, to the extent that the water is deflected, the deflection causes a turbulence where the nozzle applies turning forces to the water stream, and thus adds to the back pressure that interferes with the aeration process.

Accordingly, there has existed a definite need for a hydro-therapy spa jet to provide directionally controlled aerated water streams at moderate strength. The present invention satisfies these and other needs, and provides further related advantages.

SUMMARY OF THE INVENTION

The present invention provides a hydro-therapy spa jet to reduce the strength of a directionally controlled aerated water stream, without creating excessive back pressure, so as to propel it against a person's anatomy. The present invention satisfies these and other needs, and provides further related advantages. It provides for such an aerated water stream without creating enough back pressure to interfere with the functioning of the jet.

The invention includes a housing defining a passage for water having an upstream end and a downstream end. The housing includes an inlet connection for admitting a water stream into the housing at its upstream end. Within the housing, a first nozzle that contracts in a downstream direction is used for accelerating the water stream. This first nozzle has an upstream end that receives the water stream from the inlet connection, and a downstream end. The accelerated water stream flows from the first nozzle into and through an air inlet chamber that is defined within the housing. The air inlet chamber provides air to be entrained by the accelerated water stream so that the accelerated water stream becomes aerated. A second nozzle, also within the housing, has an upstream end and a downstream end, and receives the accelerated and aerated water stream from the air inlet chamber. The second nozzle expands in a downstream direction, and decelerating the aerated water stream.

The invention also includes a third nozzle, within the housing, for decelerating, and preferably for turning, the aerated water stream without creating turbulence or back pressure. This third nozzle includes a body that defines a chamber having an upstream end and a downstream end. The body has an inlet, at the body's upstream end, for receiving the aerated water stream from the second nozzle and then delivering it into the chamber. The body also has an orifice leading from the chamber at the chamber's downstream end for propelling the aerated water stream against the persons anatomy. The chamber expands in a downstream direction from the body inlet to the body orifice, preferably with a conical shape. Thus, the aerated water stream passes into the inlet, through the chamber with the increasing cross-section, and out through the orifice. Due to the expanding cross-section of the chamber, the water stream speed is reduced as it passes through the chamber.

A particularly advantageous feature of the invention is that the nozzle includes one or more vanes fixed within the chamber, where the vanes have a thickness that tapers down in the downstream direction such that they are thicker at an upstream end than they are at a downstream end. Preferably, this taper is from a thick, rounded upstream end, to a narrow, pointed downstream end. It is particularly preferable that the vanes have a uniform, linear taper, forming a wedge that points in the downstream direction.

This feature is advantageous, in that it causes a pressure wave in the water stream that gently diverts the water stream to a direction between the downstream tangential direction at the tapering vane wall and the downstream tangential direction at the expanding chamber surface. Thus, the water stream slows in a more uniform fashion, rather than primarily at the chamber's surface. A uniform water speed eliminates the turbulence caused by differential water speeds, and thus the rounded and tapered vanes significantly reduce turbulence within the chamber, as well as the back pressure related to that turbulence.

A second particularly advantageous feature of the invention is that the nozzle may include a rounded protrusion extending upstream within the body. Preferably, this protrusion is suspended within the body on the vanes, and has a cross-sectional area that decreases in the downstream direction. Functioning in a manner roughly analogous to the vane upstream ends, the protrusion creates a pressure wave that gently diverts the water stream to a direction between the downstream tangential direction at the protrusion and the downstream tangential direction at the expanding chamber surface. Advantageously, this feature also slows the water stream in a more uniform fashion, reducing turbulence through the chamber, as well as the back pressure related to that turbulence.

Another feature of the invention is that the vanes divide the chamber into a plurality of segments leading from the body inlet to the body orifice. The water stream entering the chamber is thus divided into several portions, each of which passes through one of the segments. Like the chamber itself, the segments expand in the downstream direction. The portion of the water stream within each segment is thus reduced in speed as it passes through that segment. Preferably, the chamber and vanes are longer than prior art nozzle designs having a chamber and vanes, allowing more distance for the aerated water stream to be controlled.

This feature provides both superior directional control and reduced turbulence. The vanes distribute turning forces to the various portions of the aerated water stream for more even directional control. Less turbulence is thus created from the response to the directional control. Furthermore, because the segments have a smaller cross-section than the chamber as a whole, there is less of a tendency for the water in the center of the water stream to achieve a higher speed than that near the edge. Thus, turbulence is further reduced. Preferably, the segments have substantially similar increases in cross-section, thus resulting in each portion of the aerated water stream reaching the same speed at the end of its segment, avoiding the creation of turbulence due to different speeds downstream from the vanes.

Yet another feature of the invention is that the body inlet contracts in the downstream direction. An advantage of this feature is that it allows the nozzle to be rotated without moving the inlet to a position where it cannot receive the aerated water stream from the second nozzle. In particular, the larger, upstream end of the inlet may be large enough to present an opening for receiving the aerated water stream in a multitude of rotated positions. Regardless of the third nozzle's position, the inlet decreases in size along the downstream direction to guide the aerated water stream into the smaller, upstream end of the chamber. While it is preferable that the inlet define such a passage, the inlet may simply be the upstream end of the chamber.

The invention also features an outer surface around the body inlet having an annular section that is spherical in shape, and an annular section having a spherical inner surface on the housing. This feature further aids the decreasing cross-sectional area of the inlet passage in receiving the aerated water stream while the nozzle is in a rotated position. In particular, the spherical outer surface may conform to, and be received within the housing's spherical inner surface to support the third nozzle while allowing it to be rotated, and the aerated water stream to be turned. This allows the center of the third nozzle's rotation to fall within the inlet, minimizing the inlet movement during rotation of the third nozzle.

The orifice of the invention features a cross-sectional area that is constant in the downstream direction. An advantage of this feature is that it accelerates the outer edges of the aerated water stream slightly, directing them in an axial (rather than conically expanding) direction. The water stream thus maintains its integrity longer when flowing out into the body of water, achieving better penetration. The accelerated and aligned edges also reduce the frictional bleed off that occurs from expanding water turning around the downstream end of the orifice. While it is preferable that the orifice be so defined, the orifice may simply be the downstream end of the chamber.

Other features and advantages of the invention will become apparent from the following detailed description, taken in conjunction with the accompanying drawings, which illustrate, by way of example, the principles of the invention.

BRIEF DESCRIPTION OF THE DRAWINGS

FIG. 3 is a perspective view of a downstream end of the third nozzle depicted in FIG. 1.

FIG. 4 is a cutaway perspective view of an upstream end of the third nozzle depicted in FIG. 1.

DESCRIPTION OF THE PREFERRED EMBODIMENT

Figure 1:
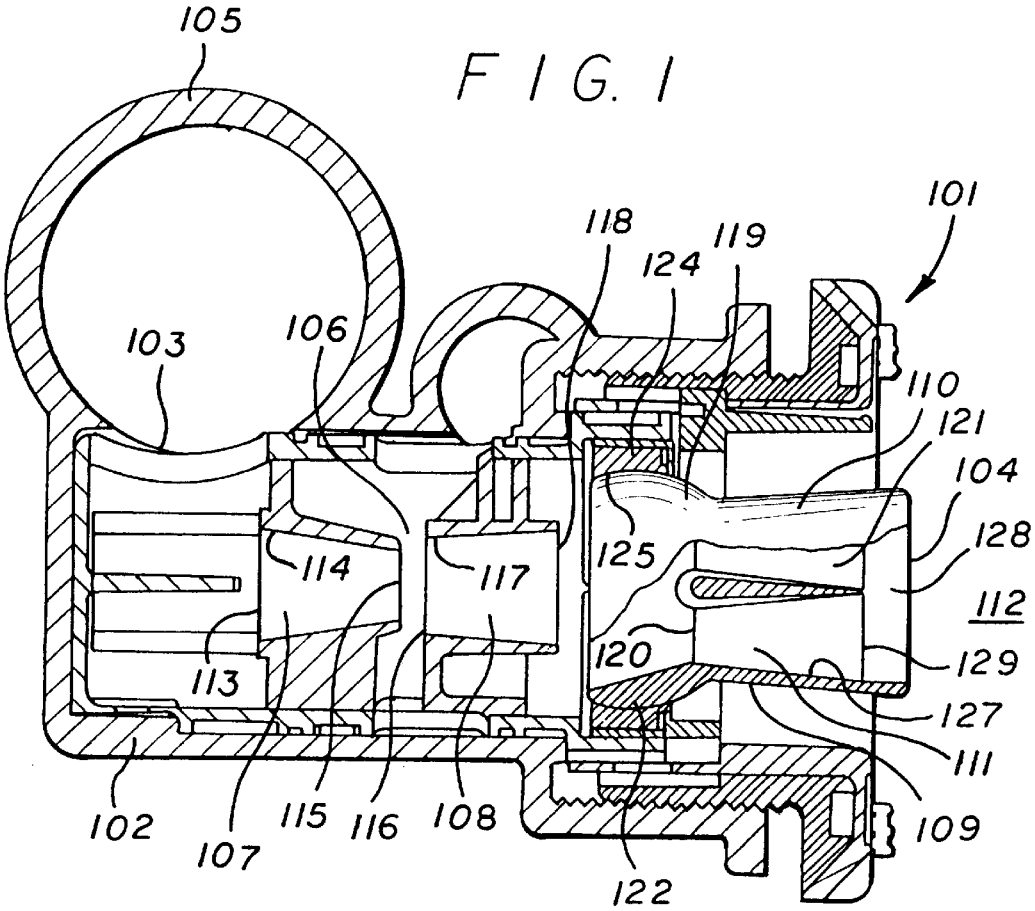
FIG. 1 is a cross-sectional elevation view of a hydro-therapy spa jet, including a first nozzle and a cutaway third nozzle, embodying features of the present invention.
Figure 2:
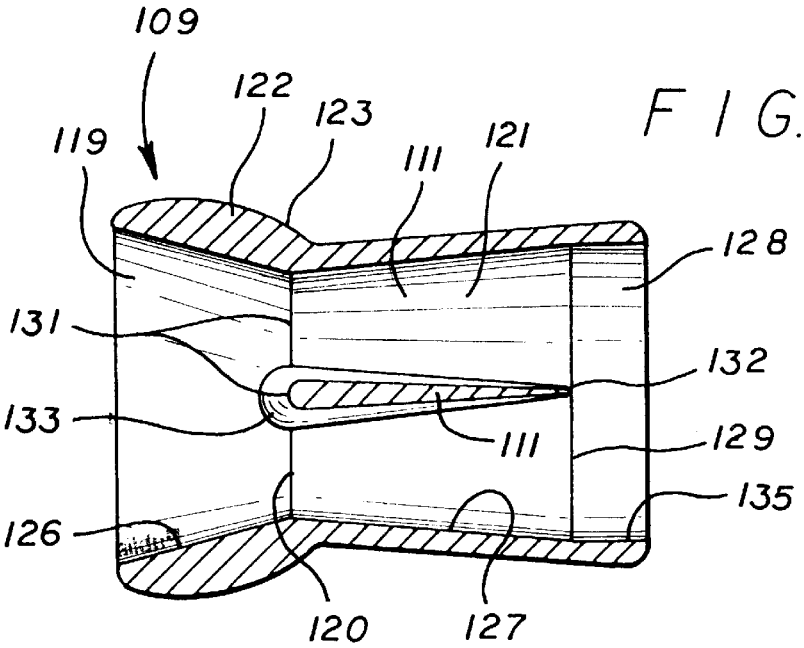
FIG. 2 is a cross-sectional elevation view of the third nozzle depicted in FIG. 1.

A hydro-therapy spa jet 101 according to the present invention is shown in FIG. 1. The system includes a housing 102 defining a passage for water having an upstream end 103 and a downstream end 104. The housing forms an inlet connection 105 containing pressurized water, and defines an air inlet chamber 106. The housing contains a first nozzle 107, a second nozzle 108, and a third nozzle 109 having a body 110 and vanes 111. The first nozzle accelerates water from the inlet connection, directing a stream of it to flow into and through the air inlet chamber defined within the housing. The air inlet chamber provides air to be entrained by the accelerated water stream, the accelerated water stream thus becoming an aerated, accelerated water stream. The aerated, accelerated water stream is then received in the second nozzle, which diverges to decelerate the aerated, accelerated water stream. The second nozzle, in turn, directs the aerated water stream into the third nozzle where it is further slowed, and may be directionally turned, to produce a comfortable, directionally-controlled, aerated water stream. The aerated water stream is propelled into a body of water 112 and against a person's anatomy, and is not uncomfortably strong. The water stream, extending from the inlet connection to the body of water, defines upstream and downstream directions within the water stream, and for objects in contact with the water stream. Objects in contact with the water stream thus may be understood to have upstream and downstream ends.

The water in the inlet connection 105 is provided at a standard pressure for a hydro-therapy spa. The inlet connection provides water into an upstream end 113 on the first nozzle 107. The first nozzle includes a conical inner surface 114 that contracts in diameter in the downstream direction. As the water stream flows into the reception end and through the first nozzle, it accelerates to a greater speed until it reaches a downstream end 115 of the first nozzle.

The downstream end 115 of the first nozzle 107 directs the accelerated water stream to flow into and through the air inlet chamber 106. The accelerated water stream entrains air from the air inlet chamber as it passes through, and thus becomes aerated. From the air inlet chamber, the aerated, accelerated water stream flows into an upstream end 116 of the second nozzle 108. The second nozzle includes an inner surface 117 having a circular cross-section that expands in diameter in the downstream direction. The increasing diameter decelerates the aerated, accelerated water stream, producing an aerated water stream. The aerated water stream then passes out a downstream end 118 of the second nozzle.

With reference to FIGS. 1–4, the downstream end 118 of the second nozzle 108 directs the aerated water stream into an inlet 119 in the third nozzle's body 110. The inlet functions to receive the aerated water stream from the second nozzle, and deliver it to an upstream end 120 of a chamber 121 within the body. The body includes an annular section 122 having a spherical outer surface 123 around the inlet. The spherical outer surface is conformingly received within an annular section 124 of the housing 102 having a spherical inner surface 125. The third nozzle is thus supported by the housing's spherical inner surface, and may be rotated within the inner surface in the same fashion that an eyeball rotates within an eye socket.

The third nozzle's inlet 119 also includes a conical inner surface 126 that contracts in a downstream direction. The inlet's conical inner surface is concentric with the inlet annular section 122. This configuration, when properly positioned with respect to the downstream end 118 of the second nozzle 108, presents the aerated water stream with an adequate entrance to the inlet regardless of the rotated position of the third nozzle 109.

The third nozzle's body 110 has another conical inner surface 127 that is concentric with the body inlet's conical surface 126. This second conical surface 127 defines the chamber 121 within the body. In a downstream direction, the chamber expands from the body inlet 119 to a body orifice 128 at a downstream end 129 of the chamber. The expanding chamber presents an increasing cross-sectional area to the aerated water stream, thus decreasing the aerated water stream's speed and lowering its pressure as it passes through the chamber.

Four vanes 111 are fixed within the chamber 121, extending from the chamber's conical surface 127 to the center of the chamber. The vanes run in the downstream direction, dividing the chamber into four separate segments 130, each of which leads from the body inlet 119 to the body orifice 128. The aerated water stream is divided into four portions, each of which enters one of the four segments of the chamber. Each portion of the aerated water stream is directed along its respective segment, receiving turning forces from that segment, and the segments thus provide for more evenly distributed directional control of the aerated water stream. This is particularly relevant when the third nozzle 109 is rotated within the housing 102 to direct the aerated water stream at an angle as it enters the body of water 112.

Just as the chamber 121 expands in a downstream direction, so to does each segment 130 expand in a downstream direction. Each portion of the aerated water stream is thus not only directionally controlled, but is also decelerated to a lower speed and pressure.

Each vane 111 includes a rounded upstream end 131, and a pointed downstream end 132. The vane tapers down in the downstream direction from a larger thickness at its upstream end to a point at its downstream end. The taper is uniform, and thus each vane is configured as a wedge pointed in the downstream direction.

This rounded upstream end configuration produces a pressure wave in the aerated water stream around the upstream end 131 of the vanes 111. The water stream is thus turned to angle slightly away from the vanes and closer to a direction tangent to chamber's conical surface 127. Because the turning occurs in conjunction with the conical increase in the chamber diameter and the taper of the vanes, laminar flow is improved through the chamber, and the turbulence that is characteristic of prior art jet nozzles is substantially reduced. Furthermore, the wedge shape's pointed downstream end provides for the integration of the four portions of the water stream without significant turbulence from mixing. Thus, the chamber's function of lowering the aerated water stream's speed and pressure while directionally controlling the aerated water stream, is accomplished without causing enough turbulence to create significant back pressure and the resulting aeration problems.

The accomplishment of the above functions of the chamber 121 is further aided by another feature of the third nozzle 109, a rounded, teardrop-shaped protrusion 133 extending upstream within the body 110 from within the chamber. The protrusion is superimposed over, and supported by, the four vanes 111 where they meet in the center of the chamber. The protrusion has a cross-sectional area that decreases down to a point 134 in the downstream direction, such that the teardrop appears to be falling in the upstream direction. The protrusion protrudes farther upstream than the vane upstream ends 131, and thus extends into the inlet 119.

The rounded protrusion 133 also produces a pressure wave in the aerated water stream. The aerated water stream is thus turned to angle slightly away from the protrusion, and closer to a direction tangent to the chamber's conical surface 127. As with the vane 111, the protrusion aids in improving laminar flow through the chamber 121, and limiting chamber turbulence. The protrusion's point 134 provides for the aerated water stream's smooth passage beyond the protrusion, and avoids the creation of significant turbulence.

Thus, the chamber's function of lowering the aerated water stream's speed and pressure while directionally controlling the aerated water stream is further aided by the protrusion.

Upon passing from the chamber 121, the aerated water stream enters the orifice 128, an annular section having an inner, cylindrical surface 135 that is concentric with the chamber's conical surface 127. Prior to entering the orifice, the aerated water stream is radially spreading in tangential conformity to the chamber's conical surface 127. The orifice's cylindrical surface turns the aerated water stream to a more axial direction, accelerating radially outer portions of the aerated water stream to slightly greater speeds than the rest of the aerated water stream. The aerated water stream may thus better maintain its integrity and improve its penetration when it passes into the body of water 112, and also avoid frictional bleed off as the aerated water stream passes from the orifice.

Thus, the aerated water stream enters the body of water 112 with a lowered speed and pressure, and with directional control. This effect is accomplished without affecting the aeration with a significant level of back pressure. As a result, the hydro-therapy spa jet 101, with its novel third nozzle 109, provides a directionally controlled aerated water stream at moderate strength that is more comfortable when directed against the anatomy of a patient.

While a particular form of the invention has been illustrated and described, it will be apparent that various modifications can be made without departing from the spirit and scope of the invention. For example, the first nozzle and second nozzle may be integrated to form a venturi. Such a configuration, with a venturi and the third nozzle, is within the scope of the invention. Thus, although the invention has been described in detail with reference only to the preferred embodiments, those having ordinary skill in the art will appreciate that various modifications can be made without departing from the invention. Accordingly, the invention is not intended to be limited, and is defined with reference to the following claims.

I claim:

1. A hydro-therapy spa jet nozzle for decelerating an aerated water stream to be propelled against a person's anatomy, comprising:

a body defining a chamber having an upstream end and a downstream end;

an inlet at said body's upstream end for receiving the aerated water stream, and delivering it into the chamber;

an orifice leading from the chamber at said body's downstream end, for propelling the aerated water stream against the person's anatomy; and at least one vane fixed within the chamber and extending from the inlet to the orifice, said at least one vane having a thickness that tapers down in the downstream direction;

wherein the chamber expands in a downstream direction from said inlet to said orifice.

2. The hydro-therapy spa jet nozzle of claim 1, wherein:

said at least one vane has an upstream end that is rounded; and said at least one vane divides the body chamber into a plurality of segments leading from said inlet to said orifice, said segments expanding in the downstream direction.

3. The hydro-therapy spa jet nozzle of claim 1, wherein said inlet contracts in a downstream direction.

4. The hydro-therapy spa jet nozzle of claim 1, and further comprising an outer surface around said inlet, having an annular section that is spherical in shape.

5. The hydro-therapy spa jet nozzle of claim 1, wherein said orifice has a cross-sectional area that is constant in the downstream direction.

6. The hydro-therapy spa jet nozzle of claim 1, and further comprising a rounded protrusion extending upstream within said body;

wherein said protrusion has a cross-sectional area that decreases in the downstream direction; and wherein said protrusion is suspended within said body on said at least one vane.

7. A hydro-therapy spa jet nozzle for decelerating an aerated water stream to be propelled against a person's anatomy, comprising:

a body defining a chamber having an upstream end and a downstream end;

an inlet at said body's upstream end for receiving the aerated water stream into the chamber;

an orifice leading from said chamber at said body's downstream end, for propelling the aerated water stream against the person's anatomy; and a rounded protrusion extending upstream and contained entirely within said body and said inlet, said protrusion tapering downwardly in the downstream direction;

wherein the chamber expands in a downstream direction from said inlet to said orifice.

8. The hydro-therapy spa jet nozzle of claim 7, wherein said protrusion has a cross-sectional area that decreases in the downstream direction.

* * * * *